US011206932B2

(12) United States Patent
Ning

(10) Patent No.: US 11,206,932 B2
(45) Date of Patent: Dec. 28, 2021

(54) PLAY YARD HAVING ADJUSTABLE BASSINET

(71) Applicant: Wonderland Switzerland AG, Steinhausen (CH)

(72) Inventor: Huan Ning, Guangdong (CN)

(73) Assignee: Wonderland Switzerland AG, Steinhausen (CH)

( * ) Notice: Subject to any disclaimer, the term of this patent is extended or adjusted under 35 U.S.C. 154(b) by 57 days.

(21) Appl. No.: 16/564,991

(22) Filed: Sep. 9, 2019

(65) Prior Publication Data

US 2020/0077805 A1 Mar. 12, 2020

(30) Foreign Application Priority Data

Sep. 12, 2018 (CN) ..... 201821494005.4

(51) Int. Cl.
*A47D 11/00* (2006.01)
*A47D 13/06* (2006.01)
*A47D 9/00* (2006.01)

(52) U.S. Cl.
CPC ..... *A47D 11/007* (2013.01); *A47D 9/00* (2013.01); *A47D 13/061* (2013.01)

(58) Field of Classification Search
CPC .... A47D 11/007; A47D 11/005; A47D 11/02; A47D 9/00; A47D 9/005; A47D 9/02; A47D 9/04; A47D 13/061; A47D 13/06; A47D 13/063; A47D 13/066; A47D 13/065
See application file for complete search history.

(56) References Cited

U.S. PATENT DOCUMENTS 4,202,065 A * 5/1980 Sullivan ..... A47D 9/005 5/99.1
6,131,218 A * 10/2000 Wang ..... A47D 7/04 5/93.1
6,182,308 B1 * 2/2001 Yang ..... A47D 7/04 24/616
7,055,191 B1 * 6/2006 Chen ..... A47D 7/04 5/93.2
2002/0092094 A1 * 7/2002 Welsh, Jr. ..... A47D 11/007 5/95
2003/0046761 A1 * 3/2003 Hsia ..... A47D 7/04 5/99.1
2005/0034232 A1 * 2/2005 Martin ..... A47D 7/02 5/95

(Continued)

*Primary Examiner* — Nicholas F Polito
*Assistant Examiner* — George Sun
(74) *Attorney, Agent, or Firm* — Burris Law, PLLC

(57) ABSTRACT

A play yard includes a frame body having first and second sides, a bassinet, a strap and a connecting unit. The bassinet is disposed between the first and second sides, includes a backrest and has a lower end portion attached to the frame body, and an upper end portion mounted with the backrest. The strap has a fixed end fastened to the first side, and a free end connected to the second side, and supports the upper end portion. The connecting unit connects the free end to the second side such that an effective length of the strap between a portion of the strap disposed within the connecting unit and the fixed end is adjustable to change an inclination of the backrest when the free end moves relative to the connecting unit.

13 Claims, 13 Drawing Sheets

(56) References Cited

U.S. PATENT DOCUMENTS

| | | | | |
|---|---|---|---|---|
| 2005/0210581 | A1* | 9/2005 | Clapper | A47D 11/005 5/93.2 |
| 2006/0080776 | A1* | 4/2006 | Clapper | A47D 7/007 5/93.1 |
| 2009/0049605 | A1* | 2/2009 | Zhao | A47D 13/06 5/93.1 |
| 2010/0229301 | A1* | 9/2010 | Arnold, IV | A47D 7/04 5/93.2 |
| 2010/0260536 | A1* | 10/2010 | Yu | A47D 13/063 403/102 |
| 2014/0191173 | A1* | 7/2014 | Saint | A47D 13/061 256/25 |
| 2016/0052442 | A1* | 2/2016 | Yang | B65B 13/025 24/68 CD |

* cited by examiner

PLAY YARD HAVING ADJUSTABLE BASSINET

CROSS-REFERENCE TO RELATED APPLICATION

This application claims priority of Chinese Utility Model Patent Application No. 201821494005.4 filed on Sep. 12, 2018.

FIELD

The disclosure relates to a play yard, more particularly to a play yard including a bassinet with an adjustable backrest.

BACKGROUND

Generally, play yards are used to contain and provide a safe environment for a child for sleeping or playing. Typically, play yards are collapsible so they can be stored or transported easily. Play yards are usually manufactured with a frame that is made of metal and plastic materials, and a fabric body that wraps around the frame to provide an enclosure to retain the child within the play yard. In order to meet user demands, play yards can be equipped with several accessories, for example, a bassinet can be mounted to and supported by frame rods of the play yards to establish an enclosed sleep area for a child to stay therein. However, an inclination angle of the bassinet relative to the ground is usually not adjustable.

SUMMARY

Therefore, an object of the disclosure is to provide a play yard including an adjustable backrest.

According to an aspect of the present disclosure, a play yard is provided. The play yard includes a frame body, a bassinet, a strap and an adjusting mechanism. The frame body has first and second lateral sides that are opposite in a transverse direction. The bassinet is disposed between the first and second lateral sides of the frame body, includes a backrest, and has a lower end portion attached to the frame body, and an upper end portion mounted with the backrest. The strap has a fixed end fastened to the first lateral side of the frame body, and a free end connected to the second lateral side of the frame body for supporting the upper end portion of the bassinet on the strap. The adjusting mechanism includes a connecting unit connecting the free end of the strap to the second lateral side of the frame body such that an effective length of the strap between a portion of the strap disposed within the connecting unit and the fixed end is adjustable to change an inclination of the backrest when the free end moves relative to the connecting unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
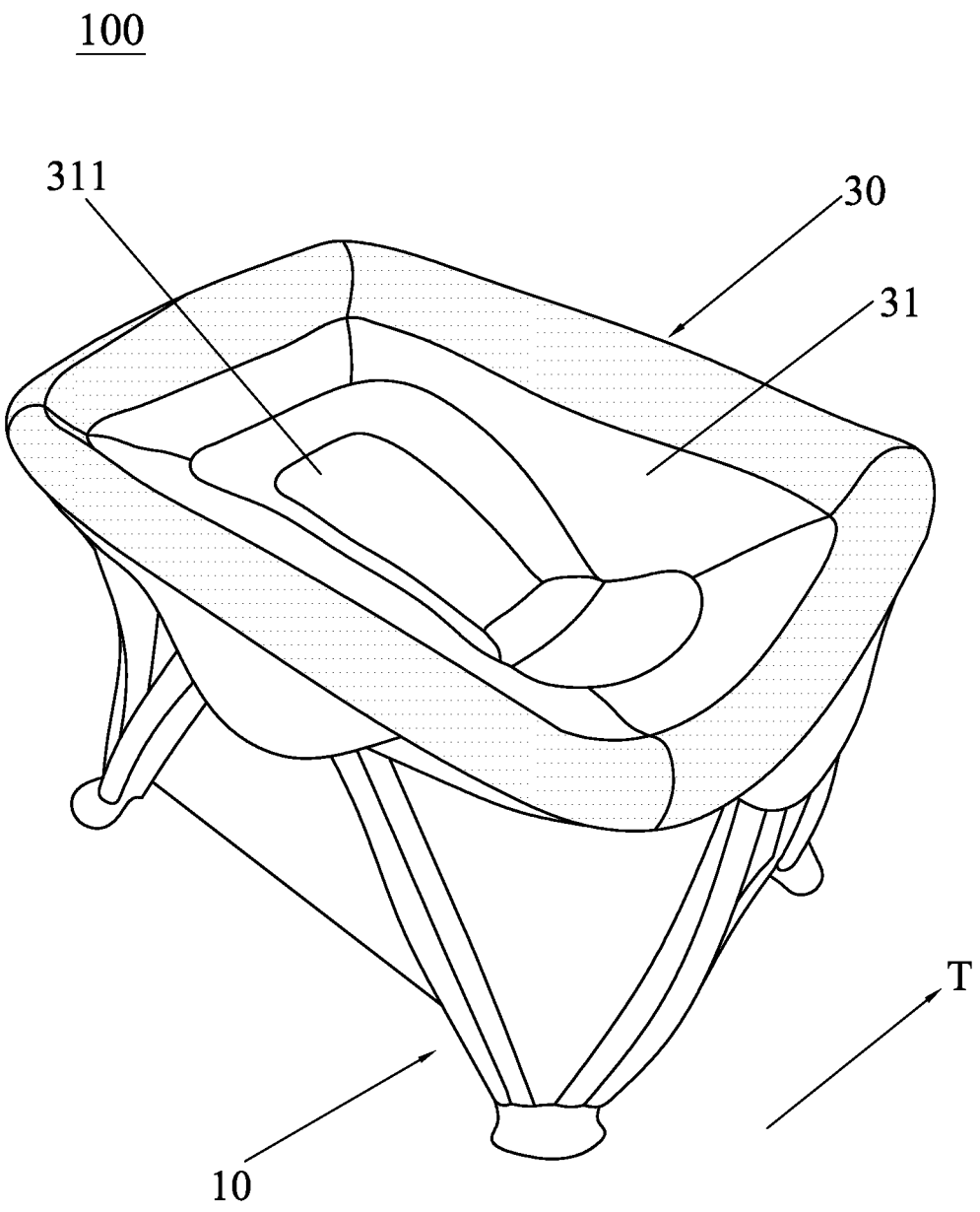
FIG. 1 is a schematic perspective view of a play yard including a bassinet according to a first embodiment of the present disclosure.

Before the present disclosure is described in greater detail with reference to the accompanying embodiments, it should be noted herein that like elements are denoted by the same reference numerals throughout the disclosure.

Referring to FIGS. 1 to 7, a play yard 100 according to a first embodiment of the present disclosure is shown. The play yard 100 includes a frame body 10, a bassinet 30, a strap 333, and an adjusting mechanism 33. The frame body 10 has first and second lateral sides 111A, 111B that are opposite in a transverse direction (T). The bassinet 30 is disposed between the first and second lateral sides 111A, 111B of the frame body 10, has a lower end portion and an upper end portion, and includes a fabric body 31 and a backrest 311. The upper and lower end portions are attached to the frame body 10 and the backrest 311 is disposed at the upper end portion. The fabric body 31 defines an accommodation space for carrying a child therein, and the upper and lower end portions of the bassinet 30 are respectively provided for supporting the head and the leg of the child placed in the accommodation space.

In this embodiment, the bassinet 30 is detachably mounted to the frame body 10 so that it is convenient to attach the bassinet 30 to the frame body 10 and to remove the bassinet 30 from the frame body 10. Specifically, the play yard 100 further includes a plurality of connectors 35 (see FIGS. 4 and 7) connecting the bassinet 30 to the frame body 10. In this embodiment, each connector 35 is a C-shape snap ring sleeved on the frame body 10, and the fabric body 31 of the bassinet 30 is attached to each connector 35. Referring back to FIG. 1, the fabric body 31 of the bassinet 30 is connected to the frame body 10 by the connectors 35.

The strap 333 has a fixed end 333A fastened to the first lateral side 111A of the frame body 10, and a free end 333B connected to the second lateral side 111B of the frame body 10 for supporting the upper end portion of the bassinet 30 on the strap 333. The adjusting mechanism 33 includes a connecting unit 331 connecting the free end 333B of the strap 333 to the second lateral side 111B of the frame body 10 such that an effective length (effective to support the bassinet 30) of the strap 333 between a portion of the strap 333 disposed within the connecting unit 331 and the fixed end 333A is adjustable to change an inclination of the backrest 311 when the free end 333B moves relative to the connecting unit 331. Further detailed structure of the connecting unit 331 and the strap 333 will be described later.

Figure 2:
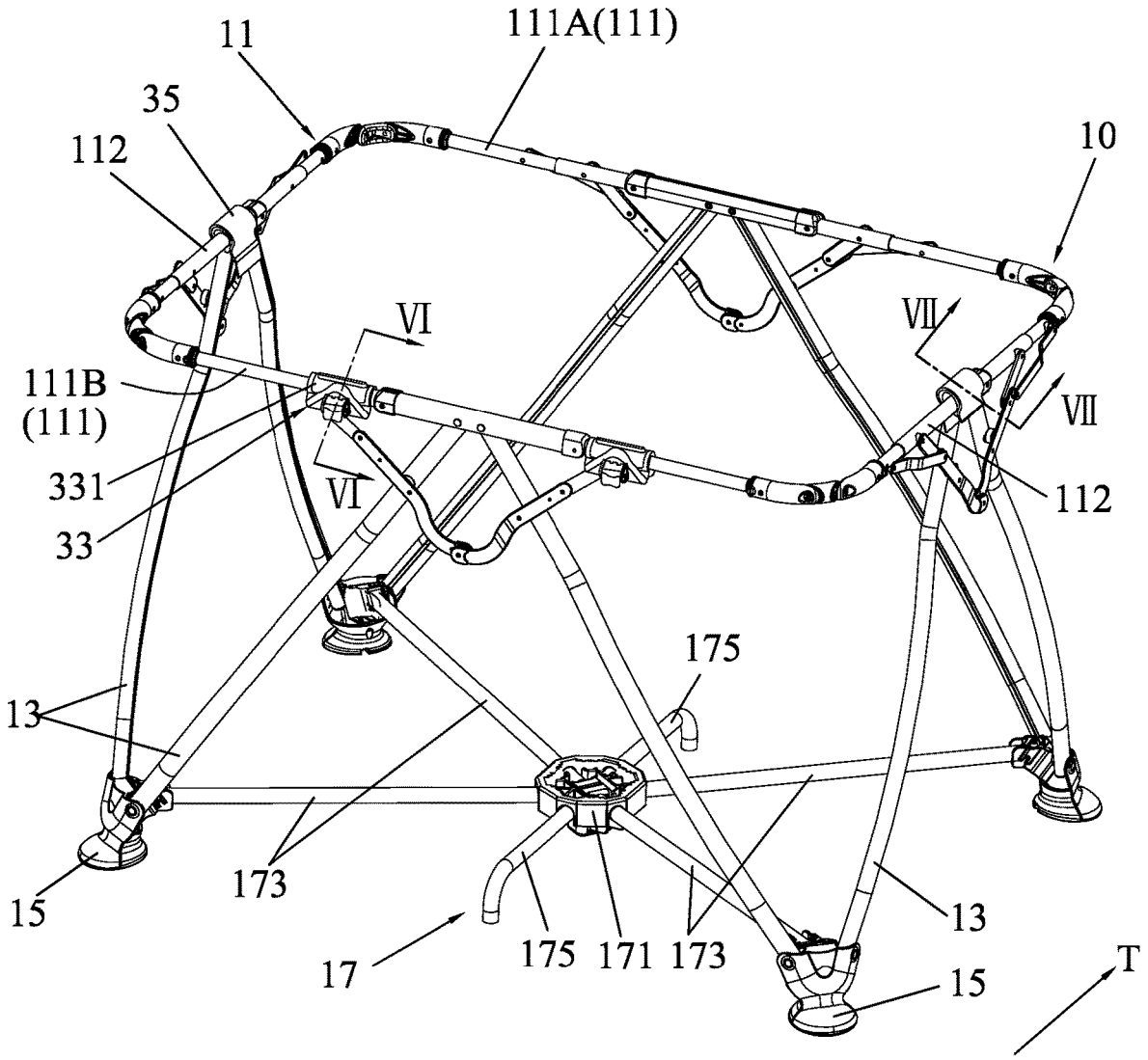
FIG. 2 is a schematic perspective view of a frame body of the play yard according to the first embodiment.

As shown in FIG. 2, the frame body 10 includes a handrail unit 11, a plurality of supporting rods 13 and four foot members 15. The handrail unit 11 includes two lateral side rods 111 disposed respectively at the first and second lateral sides 111A, 111B, and two transverse rods 112 transverse to the first and second lateral side rods 111 and extending in the transverse direction (T). Opposite ends of each transverse rod 112 are connected respectively to the lateral side rods 111 to form an enclosed area with a substantially rectangular shape for mounting of the bassinet 30. In this embodiment, the lateral side rods 111 and the transverse side rods 112 constitute the handrail unit 111.

Each of the supporting rods 13 has top and bottom ends. Adjacent top ends of any two adjacent ones of the supporting rods 13 are connected respectively to the middle of one of the lateral side rods 111 and the transverse side rods 112 so as to form a plurality of inverted V-shaped structures. Adjacent bottom ends of any two adjacent ones of the supporting rods 13 are connected to one of the foot members 15 so as to form a plurality of V-shaped structures. In one embodiment, the inverted V-shaped structures and the V-shaped structures cooperate to provide a relatively stable support to the bassinet 30. Note that the number of the supporting rods 13 is eight in this embodiment, and the numbers of the supporting rods 13 and the foot members 15 are not limited to the example described herein.

The frame body 10 further includes a bottom supporting frame 17. The bottom supporting frame 17 includes a bottom seat 171 and a plurality of bottom supporting rods 173 each having opposite ends connected respectively to the bottom seat 171 and one of the foot members 15. In this embodiment, the number of the bottom supporting rods 173 is four, and the bottom seat 171 is configured as a disc. Additionally, the bottom supporting frame 17 further includes a plurality of supporting legs 175. Each of the supporting legs 175 has a straight portion connected to the bottom seat 171, and a bent portion connected to the straight portion and bent toward the ground to provide a relatively stable structure for the play yard 100.

Figure 3:
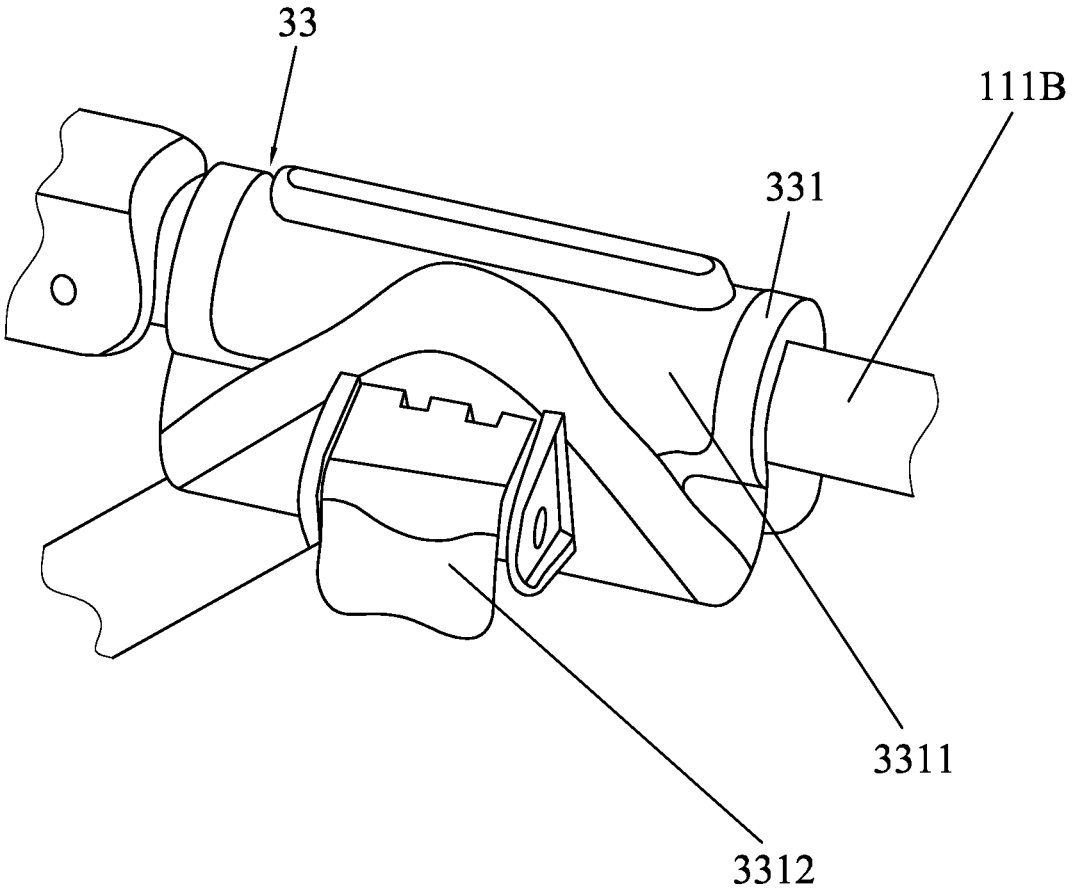
FIG. 3 is a fragmentary enlarged perspective view of an adjusting mechanism of the play yard according to the first embodiment.

As shown in FIG. 3, the connecting unit 331 includes an anchored element 3311 and an engaging element 3312. The anchored element 3311 is fixedly connected to the second lateral side 111B of the frame body 10. The engaging element 3312 is pivotally connected to the anchored element 3311, is configured to limit length adjustment of the strap 333, and is operable to pivot between an engaged position and a disengaged position. The engaging element 3312 engages the strap 333 when in the engaged position, so that the free end 333B is allowed to move relative to the connecting unit 331 in a single direction as indicated by arrow (K) in FIG. 6 away from the fixed end 333A such that the effective length of the strap 333 is shortened. The engaging element 3312 is disengaged from the strap 333 when in the disengaged position, so that the free end 333B is allowed to move relative to the connecting unit 331 in both directions such that the effective length is shortened and lengthened. In this way, the effective length of the strap 333 for supporting the backrest 311 can be adjusted according to user demand. In this embodiment, an inclination angle of the backrest 311 that can be adjusted according to the effective length ranges from 14° to 21°. Note that the main feature of the present disclosure does not reside in the specific angle of the backrest 311 inclined relative to the ground and thus further details of the same are not limited to a specific example. Additionally, the free end 333B of the strap 333 can be provided with a ring (see FIG. 4) that may be square or have any shape ergonomic for adjusting the effective length of the strap 333.

Figure 6:
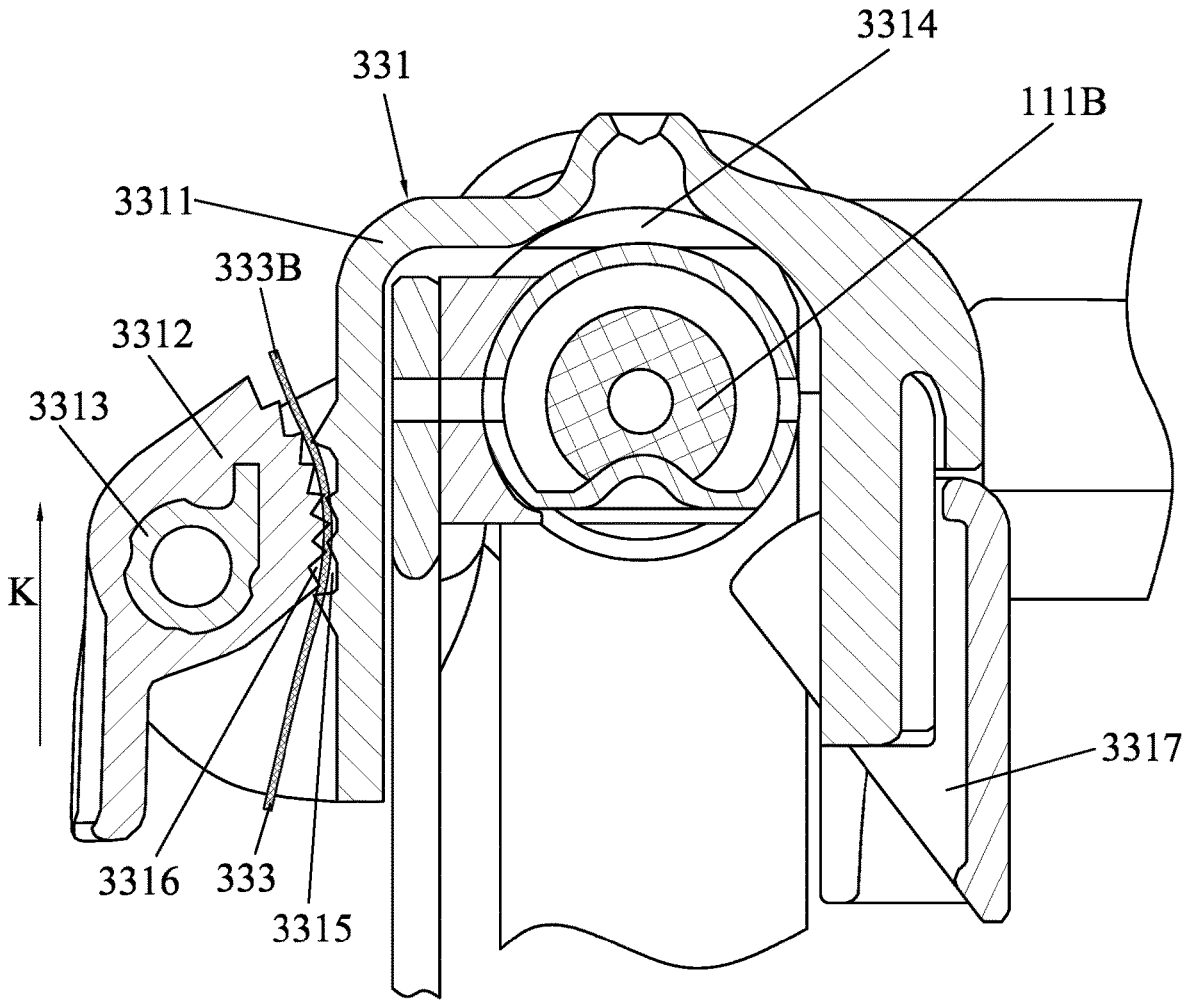
FIG. 6 is a schematic sectional view taken along line VI-VI in FIG. 2.
Figure 7:
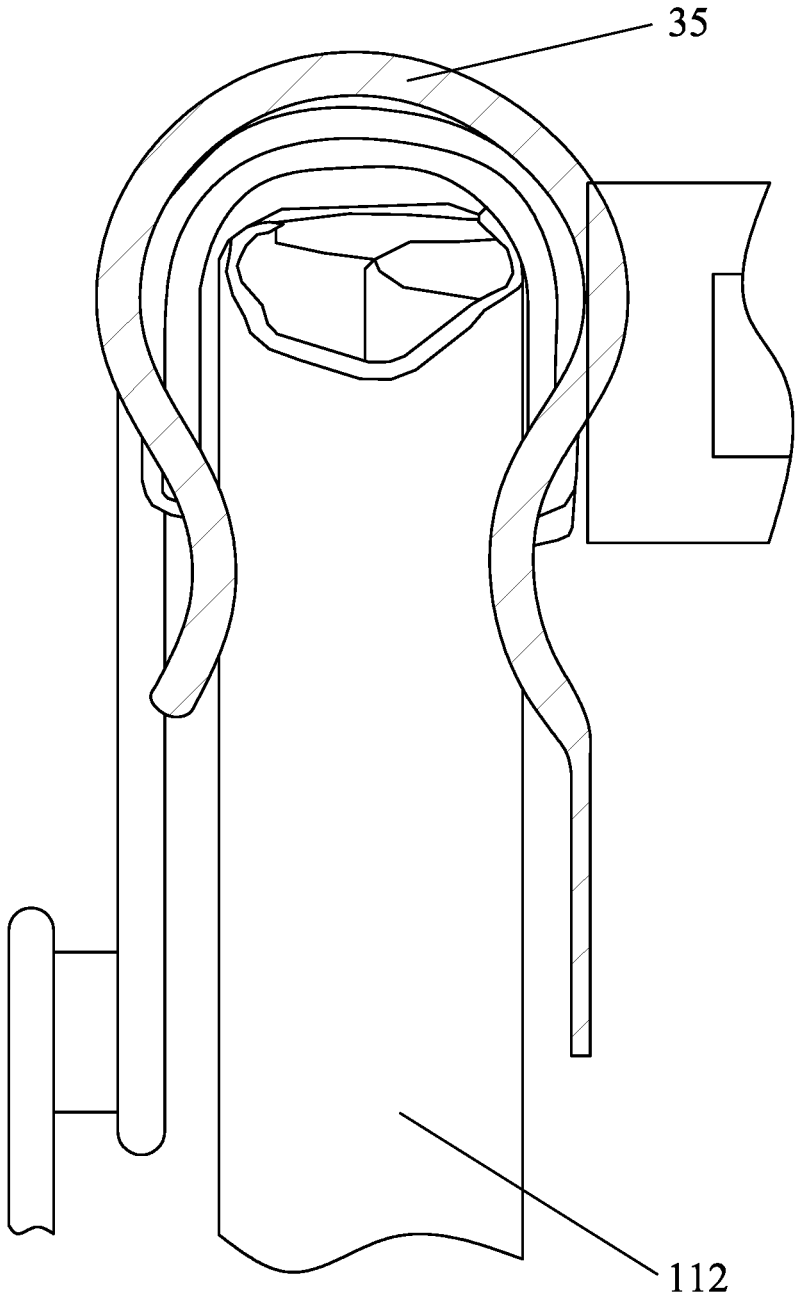
FIG. 7 is a schematic sectional view taken along line VII-VII in FIG. 2.
Figure 8:
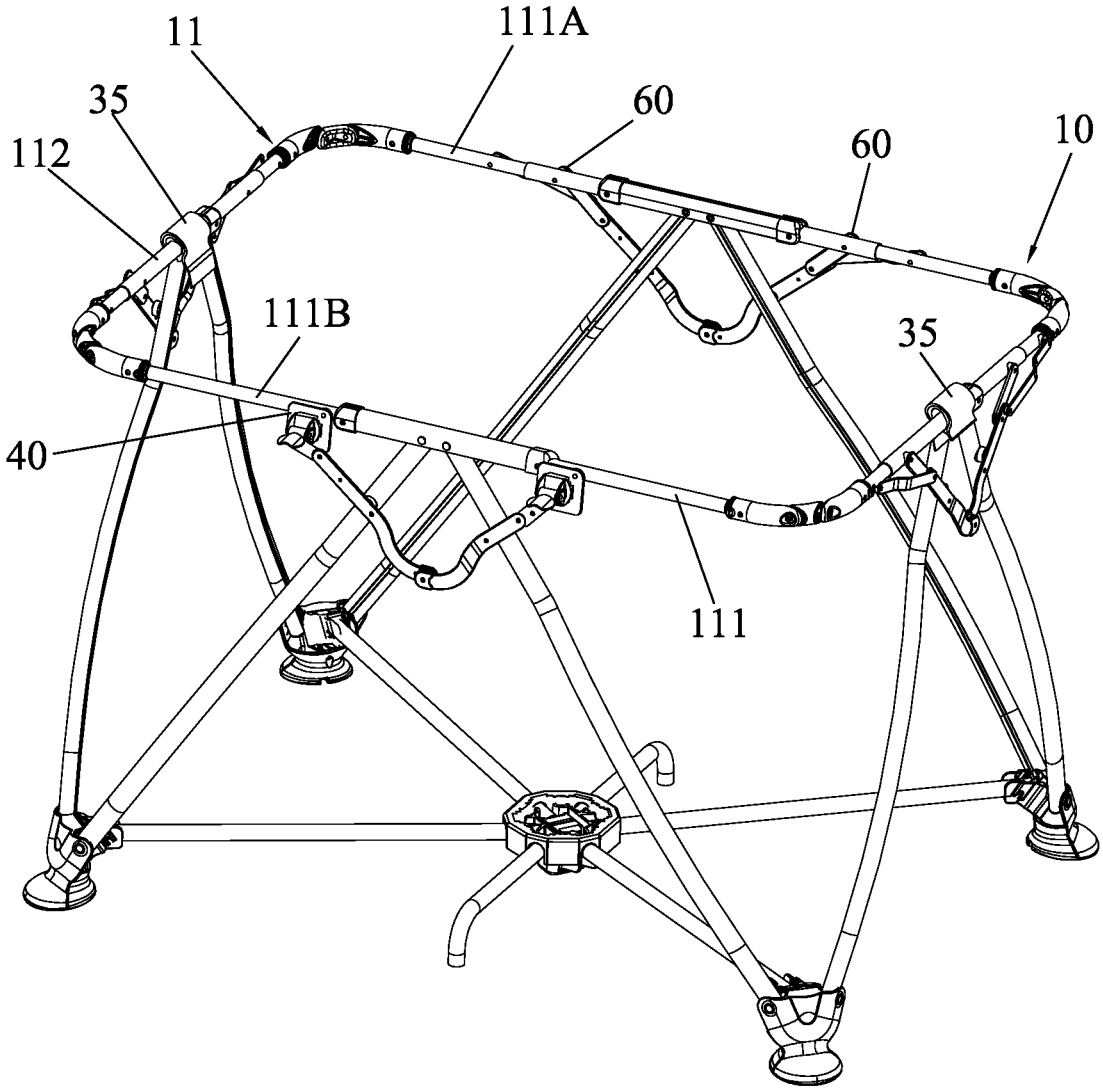
FIG. 8 is a perspective view of a frame body of a play yard according to a second embodiment of the present disclosure.
Figure 9:
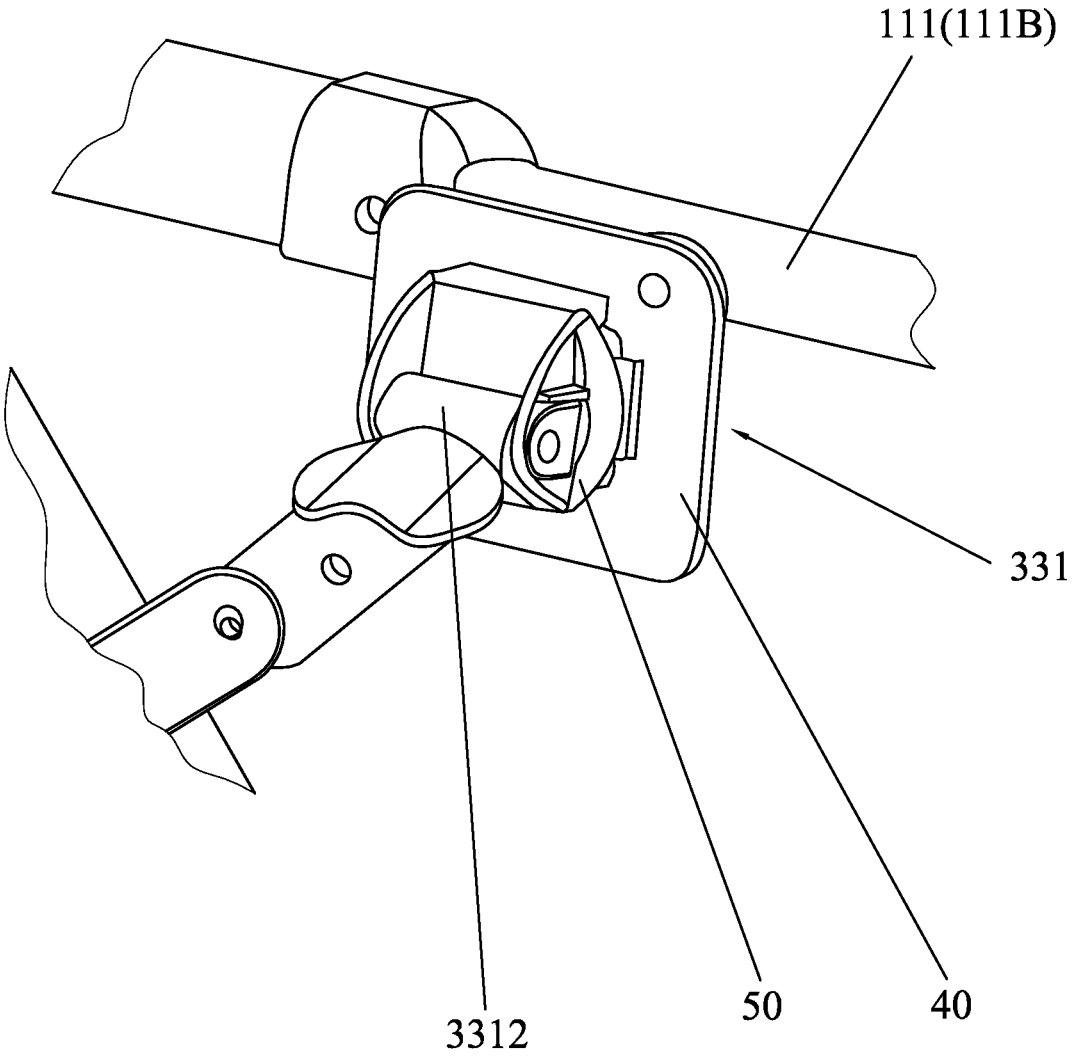
FIG. 9 is a fragmentary enlarged perspective view of a connecting unit of the adjusting mechanism, illustrating the connecting unit including a first mount connected to the frame body and a coupling member detachably mounted on the first mount.
Figure 10:
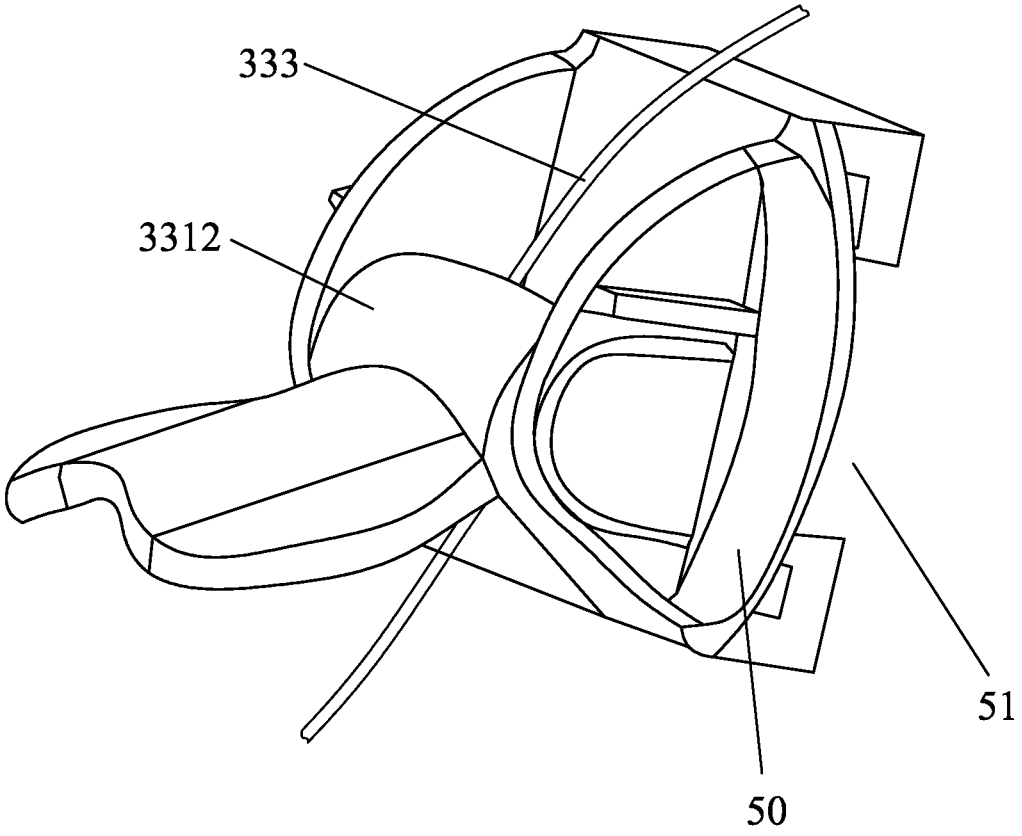
FIG. 10 is a schematic enlarged perspective view of an engaging element of the connecting unit pivotally connected to the coupling member, and the strap snapped into a space between the engaging element and the connecting unit.
Figure 11:
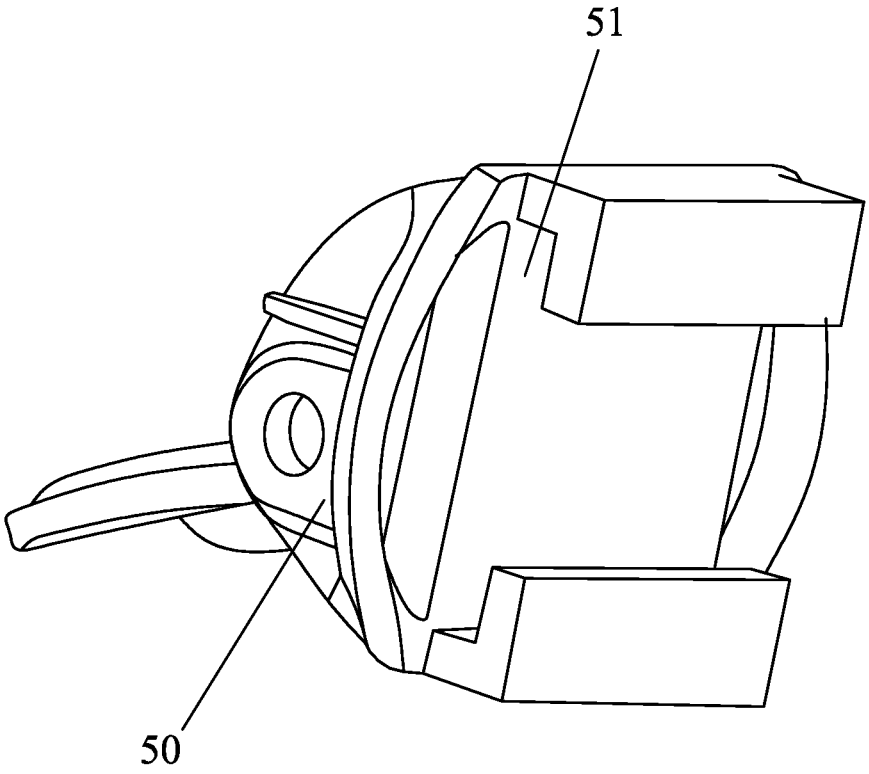
FIG. 11 is another schematic perspective view of the coupling member of FIG. 10.
Figure 12:
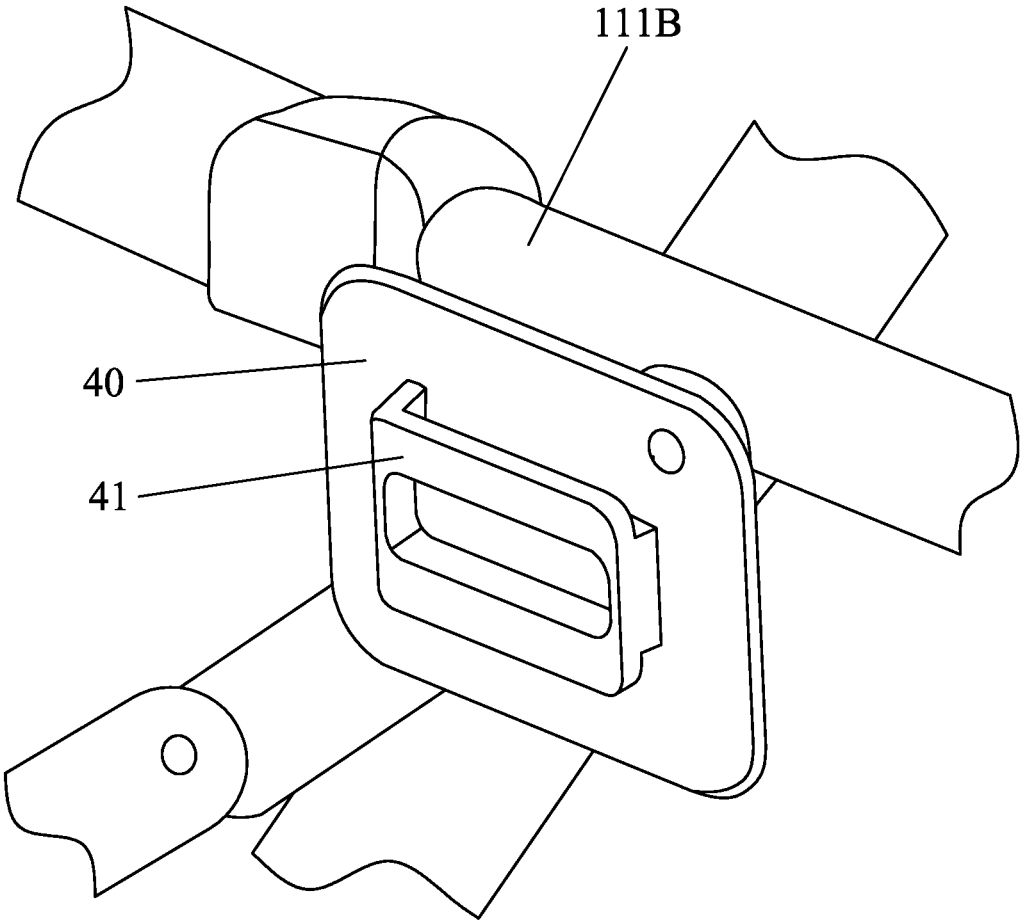
FIG. 12 is a fragmentary enlarged perspective view of the first mount.

As shown in FIG. 6, the anchored element 3311 is formed with a plurality of pawls 3315 and the engaging element 3312 is formed with a ratchet portion 3316 that engages the pawls 3315 when the engaging element 3312 is in the engaged position and that is disengaged from the pawls 3315 when the engaging element 3312 is in the disengaged position. The strap 333 is snapped into a space between the pawls 3315 and the ratchet portion 3316 such that the free end 333B is allowed to move in the direction away from the fixed end 333A when the engaging element 3312 is in the engaged position so as to shorten the effective length of the strap 333. The free end 333B is unsnapped when the engaging element 3312 is in the disengaged position such that the free end 333B is allowed to move relative to the connecting unit 331 in both directions so as to shorten and lengthen the effective length of the strap 333.

The connecting unit 331 further includes a biasing member 3313 connected to the engaging element 3312 and biasing the engaging element 3312 to the engaged position. As such, the free end 333B is limited to move in a single direction to shorten the effective length of the strap 333, and thus the effective length of the strap 333 cannot be lengthened without operating the engaging element 3312 to the disengaged position, such that the backrest 311 is prevented from undesirable falling. In this embodiment, the biasing member 3313 is a torsion spring and the present disclosure is not limited to this example.

The anchored element 3311 is formed with a connecting space 3314 for receiving a portion of the fabric body 31 therein. In this embodiment, the anchored element 3311 is mounted to the frame body 10 and a portion of the fabric body 31 extends into the connecting space 3314 to be connected to the frame body 10 by a plurality of plastic steel rods. The fixed end 333A of the strap 333 is connected to one of the connectors 35 that is connected to the first lateral side 111A of the frame body 10. The free end 333B of the strap 333 is snapped between the pawls 3315 of the anchored element 3311 and the ratchet portion 3316 of the engaging element 3312 and is connected to the second lateral side 111B of the frame body 10. When the fabric body 31 is mounted to and supported by the frame body 10, the strap 333 connected between the first and second lateral sides 111A, 111B of the frame body 10 supports the backrest 311 and is provided to adjust inclination of the backrest 311. By virtue of the anchored element 3311 and the connectors 35, the strap 333 is disposed across the backrest 311 to support the fabric body 31 and thus creases on the fabric body 31 can be alleviated. In this embodiment, the strap 333 is a fabric strap and provides a relatively strong support for a relatively heavy child.

Figure 4:
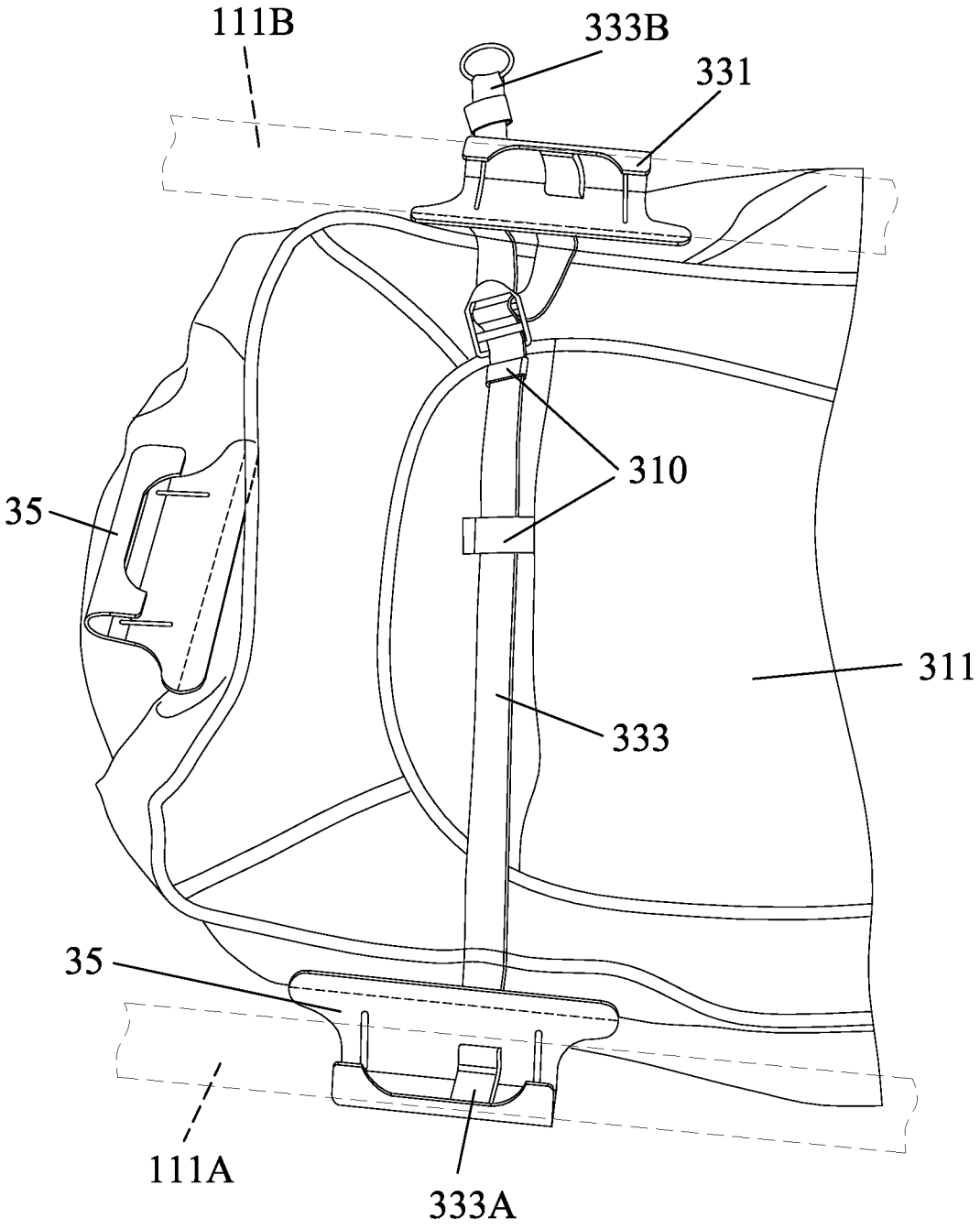
FIG. 4 is a schematic bottom view of the bassinet of the play yard according to the first embodiment, illustrating a strap disposed across a backrest of the bassinet.

As shown in FIG. 4, in this embodiment, the play yard 100 further includes a plurality of position limiting elements 310 woven to and disposed under the fabric body 31 and each having a structure similar to that of a belt loop. The strap 333 extends through the position limiting elements 310 so as to support the fabric body 31 without knotting and to provide a neat appearance.

Figure 5:
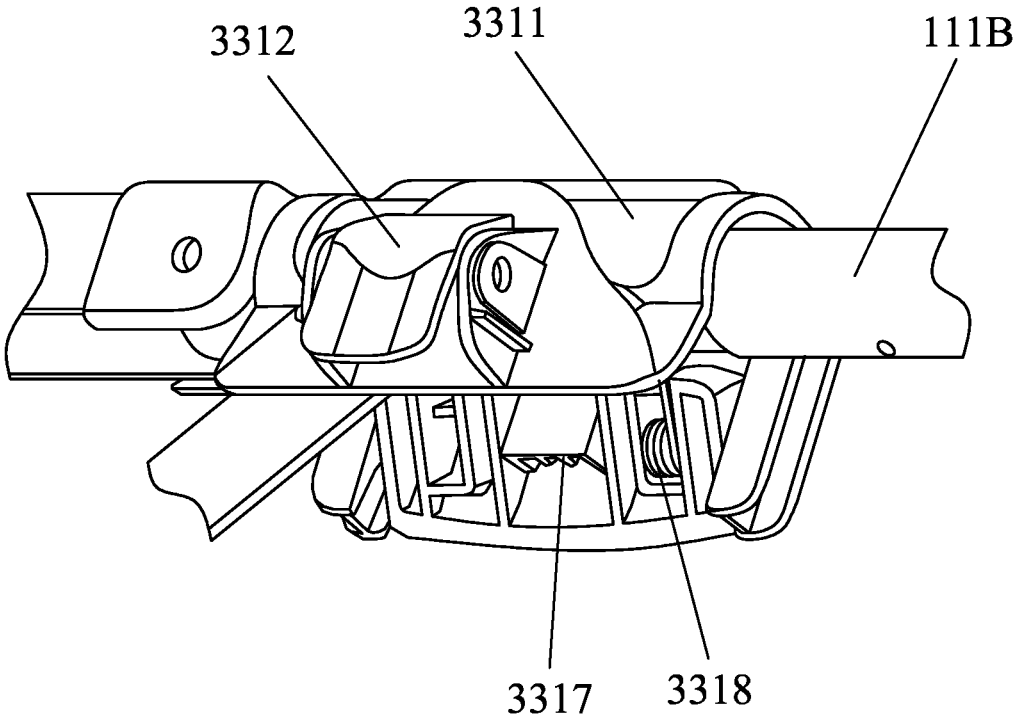
FIG. 5 is a fragmentary enlarged perspective view of the adjusting mechanism mounted to the frame body of the play yard according to the first embodiment.

As shown in FIG. 5, the anchored element 3311 further includes an interconnecting element 3317 and a restoring member 3318. The interconnecting element 3317 interconnects the anchored element 3311 and the second lateral side 111B of the frame body 10. In this embodiment, the restoring member 3318 is a torsion spring operable to be twisted by the interconnecting element 3317 and to allow the frame body 10 to be detachably connected to the anchored element 3311. Note that the present disclosure is not limited in the specific structure of the restoring member 3313 disclosed herein.

During use, the fabric body 31 is first mounted to the frame body 10 of the play yard 100 by the connectors 35 and the connecting unit 331 so as to form the accommodation space for carrying a child. Specifically, the connecting space 3314 of the anchored element 3311 receives a portion of the fabric body 31 therein and the anchored element 3311 is connected to the second lateral side 111B of the frame body 10 through the interconnecting element 3317. The connectors 35 to which the fabric body 31 is attached are sleeved on the frame body 10. The free end 333B of the strap 333 extends through the position limiting elements 310 and is snapped into the space between the anchored element 3311 and the engaging element 3312. The fixed end 333A of the strap 333 is then connected to the first lateral side 111A of the frame body 10 through one of the connectors 35. In this way, the effective length of the strap 333 between a portion of the strap 333 disposed within the connecting unit 331 and the fixed end 333A for supporting the backrest 311 can be adjusted by operating the free end 333B of the strap 333 when the engaging element 3312 is in the disengaged position. Thus, the inclination of the backrest 311 supported by the strap 333 can be changed according to user demand.

Referring to FIGS. 8 to 13, a frame body 10 of the play yard 100 according to a second embodiment of the present disclosure is shown. The second embodiment is similar to the first embodiment and the difference between the second embodiment and the first embodiment resides in the followings. In the second embodiment, the anchored element 3311 shown in FIG. 6 is omitted and the connecting unit 331 further includes a first mount 40 connected fixedly to the second lateral side 111B of the frame body 10, and a coupling element 50 detachably connected to the first mount 40. Specifically, the first mount 40 is mounted to one of the lateral side rods 111 disposed at the second lateral side 111B. In this embodiment, the engaging element 3312 is pivotally connected to the coupling element 50 and can pivot between the engaged position and the disengaged position, and the free end 333B of the strap 333 extends between a space between the coupling element 50 and the engaging element 3312. The first mount 40 includes a dovetail tongue 41. The coupling element 50 includes a dovetail groove portion 51 detachably engaging the dovetail tongue 41. Note that in other embodiments, the coupling element 50 may include a dovetail tongue, and the first mount 40 includes a dovetail groove portion detachably engaging the dovetail tongue, and the present disclosure is not limited to the specific structure disclosed in this example as long as the coupling element 50 can be detachably mounted to the first mount 40.

In this embodiment, the anchored element 3311 formed with the connecting space 3314 for receiving a portion of the fabric body 31 therein is omitted, and the first mount 40 is merely mounted to the second lateral side 111B of the frame body 10 without connecting with the fabric body 31. Therefore, a C-shaped snap ring, for example, one of the connectors 35 shown in FIG. 7 attached to the fabric body 31 is provided to be sleeved on one of the lateral side rods 111 disposed at the second lateral side 111B so as to connect the fabric body 31 to the frame body 10.

Figure 13:
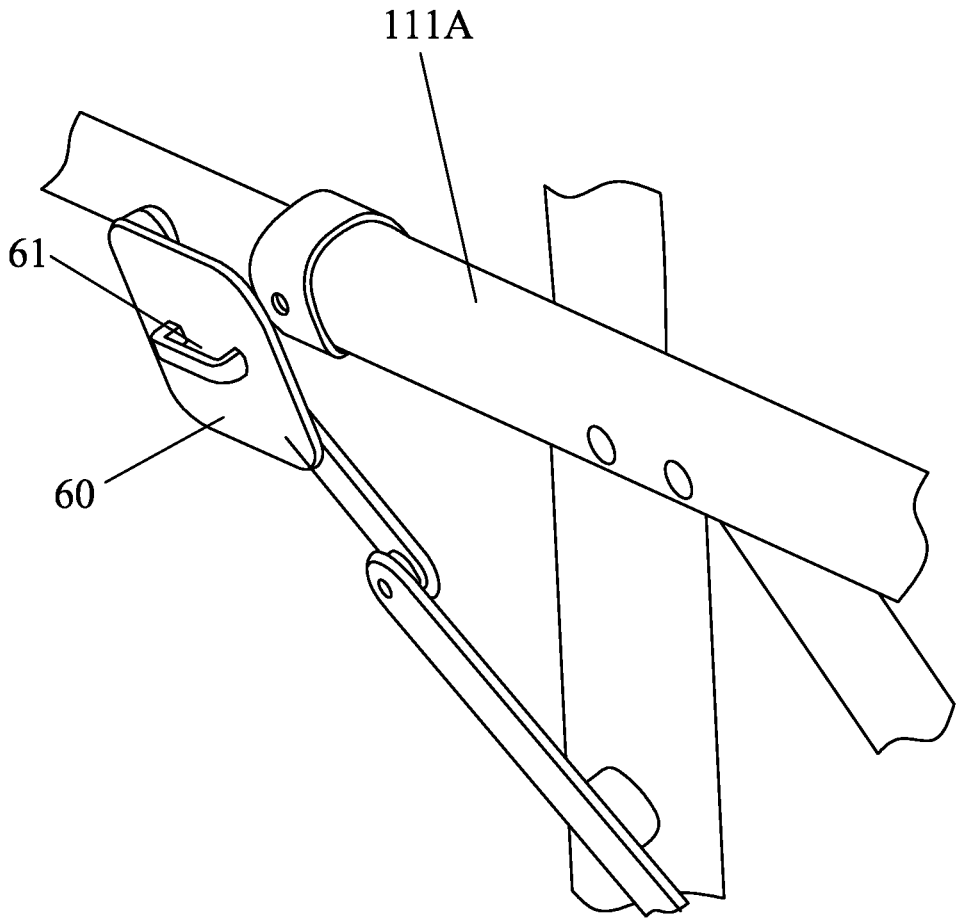
FIG. 13 is a fragmentary perspective view of a second mount of the connecting unit mounted to the frame body.

Further referring to FIG. 13, the adjusting mechanism 33 further includes a second mount 60 connected fixedly to the first lateral side 111A of the frame body 10 and formed with a mounting slot 61 that is defined by a U-shaped strip. The fixed end 333A of the strap 333 is fastened to the U-shaped strip and extends through the mounting slot 61 of the second mount 60. Specifically, the second mount 60 is mounted to one of the lateral side rods 111 disposed at the first lateral side 111A. In this embodiment, the strap 333 is configured as a ribbon (not shown) fixedly tied to the U-shaped strip but the present disclosure is not limited to this example. In this way, the strap 333 is disposed between the first and second mounts 40, 60 to support the upper end portion of the bassinet 30 (see FIG. 1), and the effective length of the strap 333 is adjustable to change the inclination of the backrest 311 by operating the free end 333B when the engaging element 3312 is in the disengaged position. The manner for adjusting the inclination of the backrest 311 of the second embodiment is similar to the first embodiment, and thus further details of the same are omitted for the sake of brevity.

To sum up, by virtue of the configurations of the strap 333 and the adjusting mechanism 33, the effective length of the strap 333 between a portion of the strap disposed within the connecting unit and the fixed end is simple to be shortened or lengthened to change the inclination of the backrest 311 when the free end 333B moves relative to the connecting unit 331.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A play yard comprising:

a frame body having first and second lateral sides that are opposite in a transverse direction;

a bassinet disposed between said first and second lateral sides of said frame body, including a backrest, and having a lower end portion attached to said frame body, and an upper end portion mounted with said backrest;

a strap having a fixed end fastened to said first lateral side of said frame body, and a free end connected to said second lateral side of said frame body, the strap being disposed under the backrest for supporting said backrest of said bassinet thereon and for adjusting an inclination of the backrest;

wherein the frame body has opposing longitudinal end portions, the strap being disposed only at one of the longitudinal end portions; and an adjusting mechanism including a connecting unit connecting said free end of said strap to said second lateral side of said frame body such that a length of a portion of the strap disposed between the first and second lateral sides is adjustable to change the inclination of said backrest by adjusting a location of said free end relative to said connecting unit.

2. The play yard as claimed in claim 1, wherein said connecting unit includes an engaging element configured to limit length adjustment of said strap and operable to change between an engaged position and a disengaged position, said engaging element engaging said strap when in the engaged position, so that said free end is allowed to move relative to said connecting unit in a single direction away from said fixed end such that said effective length is shortened, said engaging element being disengaged from said strap when in the disengaged position, so that said free end is allowed to move relative to said connecting unit in both directions such that said effective length is shortened and lengthened.

3. The play yard as claimed in Claire 2, wherein said connecting unit includes an anchored element fixedly connected to said second lateral side of said frame body, said engaging element being pivotally connected to said anchored element to pivot between the engaged position and the disengaged position.

4. The play yard as claimed in claim 3, wherein one of said anchored element and said engaging element is formed with a ratchet portion and the other one of said anchored element and said engaging element is formed with at least one pawl engageable with said ratchet portion.

5. The play yard as claimed in claim 3, wherein said anchored element is formed with at least one pawl and said engaging element is formed with a ratchet portion that engages said at least one pawl when said engaging element is in the engaged position and that is disengaged from said at least one pawl when said engaging element is in the disengaged position, said strap being snapped into a space between said pawl and said ratchet portion such that said free end is allowed to move in the direction away from said fixed end when said engaging element is in the engaged position, said free end being unsnapped when said engaging element is in the disengaged position.

6. The play yard as claimed in claim 2, wherein said connecting unit further includes a biasing member connected to said engaging element and biasing said engaging element to the engaged position.

7. The play yard as claimed in claim 3, wherein said bassinet has a bassinet body, and said anchored element is formed with a connecting space for receiving a portion of said bassinet body therein.

8. The play yard as claimed in claim 1, wherein said bassinet has a bassinet body, said play yard further comprising a plurality of position limiting elements woven to and disposed under said bassinet body, said strap extending through said position limiting elements so as to support said bassinet body.

9. The play yard as claimed in claim 1, further comprising a plurality of connectors fixedly connecting said bassinet to said frame body.

10. The play yard as claimed in claim 9, wherein each of said connectors is a C-shape snap ring connected fixedly to said bassinet and sleeved on a portion of said frame body.

11. The play yard as claimed in claim 2, wherein said connecting unit further includes a first mount connected fixedly to said second lateral side of said frame body, and a coupling element detachably connected to said first mount, said engaging element being pivotally connected to said coupling element and pivotable between the engaged position and the disengaged position.

12. The play yard as claimed in claim 11, wherein said adjusting mechanism further includes a second mount connected fixedly to said first lateral side of the frame portion, said fixed end of said strap being fastened to said second mount.

13. The play yard as claimed in claim 11, wherein one of said first mount and said coupling element includes a dovetail tongue, and the other one of said first mount and said coupling element includes a dovetail groove portion detachably engaging said dovetail tongue.

* * * * *